US006412998B1

(12) United States Patent
Ham

(10) Patent No.: US 6,412,998 B1
(45) Date of Patent: Jul. 2, 2002

(54) MULTI-FUNCTION WRITING INSTRUMENT

(75) Inventor: Soojung Ham, Providence, RI (US)

(73) Assignee: A.T.X. International, Inc., Lincoln, RI (US)

( * ) Notice: Subject to any disclaimer, the term of this patent is extended or adjusted under 35 U.S.C. 154(b) by 0 days.

(21) Appl. No.: 09/876,626

(22) Filed: Jun. 7, 2001

(51) Int. Cl.[7] ..... B43K 27/08; B43K 29/00

(52) U.S. Cl. ..... 401/17; 401/18; 401/19; 401/29; 401/30; 401/34

(58) Field of Search ..... 401/17, 18, 19, 401/29, 30, 31, 32, 34

(56) References Cited

U.S. PATENT DOCUMENTS

| | | | | | |
|---|---|---|---|---|---|
| 1,003,190 | A | * | 9/1911 | Mason | 401/17 X |
| 1,334,860 | A | | 3/1920 | Hughes | |
| D59,945 | S | | 12/1921 | Zdanowicz | |
| 1,402,164 | A | | 1/1922 | Houser | |
| 1,683,485 | A | * | 9/1928 | Rall | 401/17 X |
| D78,794 | S | | 6/1929 | Sheaffer | |
| D145,587 | S | | 9/1946 | Reynolds | |
| D150,647 | S | | 8/1948 | Pearl | |
| D151,233 | S | | 10/1948 | Goessling | |
| D160,757 | S | | 10/1950 | Weiss | |
| 3,260,242 | A | | 7/1966 | Liguori | |
| 3,518,017 | A | | 6/1970 | Schmidt | |
| 3,733,139 | A | | 5/1973 | Neidhardt et al. | |
| 3,801,206 | A | | 4/1974 | Poritz | |
| 4,213,717 | A | | 7/1980 | Lin | |
| 4,227,822 | A | | 10/1980 | Kokubu | |
| 4,359,291 | A | | 11/1982 | Lum | |
| 4,738,557 | A | | 4/1988 | Yumoto | |
| 4,872,774 | A | * | 10/1989 | Rosso | 401/29 |
| D328,917 | S | | 8/1992 | Shike et al. | |
| D334,589 | S | | 4/1993 | Shike et al. | |
| D368,930 | S | | 4/1996 | Payne | |
| 5,564,850 | A | | 10/1996 | Nagaoka | |
| D390,872 | S | | 2/1998 | Sunaga | |
| D403,355 | S | | 12/1998 | Fillion | |
| 5,895,160 | A | * | 4/1999 | Ginelli | 401/17 |
| D409,657 | S | | 5/1999 | Veillon et al. | |
| D409,658 | S | | 5/1999 | Chevalier et al. | |
| 5,899,618 | A | | 5/1999 | Kobayashi et al. | |
| D412,183 | S | | 7/1999 | Stukenkemper | |
| D414,203 | S | | 9/1999 | Stukenkemper | |
| D416,941 | S | | 11/1999 | Chevalier et al. | |
| 6,149,330 | A | | 11/2000 | Chuang | |

* cited by examiner

*Primary Examiner*—Charles R. Eloshway
*Assistant Examiner*—Kathleen J. Prunner
(74) *Attorney, Agent, or Firm*—Notaro & Michalos PC

(57) ABSTRACT

A single writing instrument has multiple marking tips combined with a non-marking stylus tip. The single writing instrument is formed by two complimentary bodies which are joined together. The complimentary bodies are a front section and a rear section. The front section defines a chamber for holding ball point pen cartridges which are extendable one at a time through an opening in the front section writing tip disposed at one end of the front section. The opposite end or back of the front section is open and forms a sleeve for receiving the rear section. The rear section is bilaterally symmetric with a non-marking stylus at one end and one of a fountain pen tip, a rolling ball tip, a felt-tip marker tip, or a gel ink tip extending through a writing tip at the opposite end of the rear section. The rear section is adapted to fit into the open sleeve of the front section and be held by a frictional fit.

19 Claims, 4 Drawing Sheets

MULTI-FUNCTION WRITING INSTRUMENT

FIELD AND BACKGROUND OF THE INVENTION

The present invention relates generally to the field of writing instruments and in particular to a new and useful writing instrument configured with multiple independently selectable marking tips and a non-marking stylus tip.

There are many different types of writing instruments presently available to consumers. Mechanical pencils, ballpoint, rolling ball and fountain pens and non-marking stylii are all available to consumers as single function individual writing instruments from a number of sources. A primary drawback to single-function writing instruments is that a person must switch between distinct instruments in order to use a different writing tip. This can lead to misplacing writing instruments or requires organizers to hold each writing instrument for future use.

As a result, writing tools having two different writing tips have been developed to overcome this problem. For example, A.T. Cross Company sells a writing instrument which combines a non-marking stylus and gel ink pen in the same body under the trademark DIGITAL WRITER DUO. The A.T. Cross product has a cap for covering one end while the other is in use. Neither writing tip is retractable.

Similarly, U.S. Pat. No. Des. 328,917 illustrates a two-ended ballpoint pen having a cap for each end. The pen barrel is generally cylindrical, with textured grip portions adjacent each of the writing tips. The writing tips are tapered to openings through which the pen tips protrude. One of the caps can be placed over the other cap, but the reverse is not true. The pen tips are not shown as being retractable.

Other patents disclose writing instruments with multiple marking tips which generally extend from the same end of the instrument, combine only two different writing tips and/or require a separate cap, which is otherwise non-functional, to cover one of the writing tips or leave a marking tip exposed during use of another tip.

Combination fountain pen and pencil writing instruments are shown in expired U.S. Pat. No. Des. 59,945, U.S. Pat. No. Des. 78,794, U.S. Pat. No. Des. 151,233 and U.S. Pat. No. 1,334,860. As disclosed in each of these patents, a single cap is provided to be placed over either the fountain pen or the pencil, but one marking tip is always exposed.

Still other patents teach combinations of writing instruments in which pen points of the same general type can be alternately extended through a single writing tip or all retracted, including U.S. Pat. No. 3,260,242 for a multi-color retractable pen having four ball point pen points, each with their own ink supply, which can be alternately extended through the single writing tip of the pen. A spring-biased plunger is used to force each ink supply and pen point forward, while causing any other pen point to be retracted back into the pen barrel. The pen can function only as a ballpoint pen and lacks any other writing tips combined on the pen barrel.

U.S. Pat. No. 1,402,164 discloses a fountain pen having one permanent nib and one retractable nib. The retractable nib is carried on a sliding body which is activated from the side of the pen barrel to extend the moving nib past the fixed nib for use at the same end of the writing instrument.

A mechanical pencil and pen are provided in the same writing instrument taught by U.S. Pat. No. 4,227,822. The pencil and pen tips are alternately extended through the same writing tip of the writing instrument. The cap is fixed for axial movement when the pencil is selected so that lead can be fed to the pencil as it is used. The cap is not removable. No other writing tool is provided on the cap or writing instrument.

Other writing instruments have fixed writing points adapted to be covered by a removable cap. U.S. Pat. No. 5,564,850 is for a pen having integral non-marking stylus and marking pen tips at opposite ends of a barrel. A cap is provided for alternately covering the pen tip or stylus tip. The two tips are provided on the same body and no other writing tips are provided.

The prior art patents do not offer a solution for providing multiple marking tips in a writing instrument which is self-contained as a single instrument and does not need a cap to protect one or more writing points. None of the prior patents discloses a writing instrument which combines the benefits of one or more ballpoint tips with a fountain pen, rolling ball or felt-tip marker and a non-marking stylus, while ensuring that only the marking tip in use is exposed.

SUMMARY OF THE INVENTION

It is an object of the present invention to provide a single writing instrument having multiple marking tip functions with a non-marking stylus tip.

It is a further object of the invention to provide a multiple function writing instrument having two functional parts which combine for use as a single writing instrument.

Yet another object of the invention is to provide a multiple function writing instrument which does not require a cap having no writing function to protect any of the writing tips.

A further object of the invention is to provide a multiple function writing instrument having at least one ball point pen tip and a fountain pen, rolling ball or felt-tip marker and a non-marking stylus arranged so that each marking tip which is not being used can be protected from making stray marks.

Accordingly, a multiple function writing instrument of the invention has two complimentary bodies which are joined to form a single writing instrument for use as a ballpoint pen, non-marking stylus and one of a fountain pen, rolling ball or felt-tip marker. The two complimentary bodies are a front section and a rear section. The front section has a chamber for holding one or more ball point pen cartridges. The ball points of the cartridges are extendable one at a time through an opening in the front section writing tip. The back of the front section is open and forms a sleeve for receiving the rear section. The rear section is bilaterally symmetric with a non-marking stylus at one end and a fountain pen, rolling ball or felt-tip marker tip extending through a writing tip at the opposite end. The rear section is adapted to fit into the open sleeve of the front section and held by a frictional fit. Different rear sections may be used which have different marking tips at the end opposite the non-marking stylus, depending on the preference of the person using the writing instrument. That is, a rear section having a fountain pen tip and a stylus tip could be switched for a rear section having a rolling ball tip and stylus tip. In a preferred embodiment, the marking tips of the rear section are replaceable cartridges.

The writing instrument of the invention may be used as a ball point pen, a non-marking stylus, or a fountain pen, rolling ball or felt-tip marker, depending on which point is exposed for use. All of the marking tips may be retracted or protected, so that stray marks are not made when another tip is in use.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
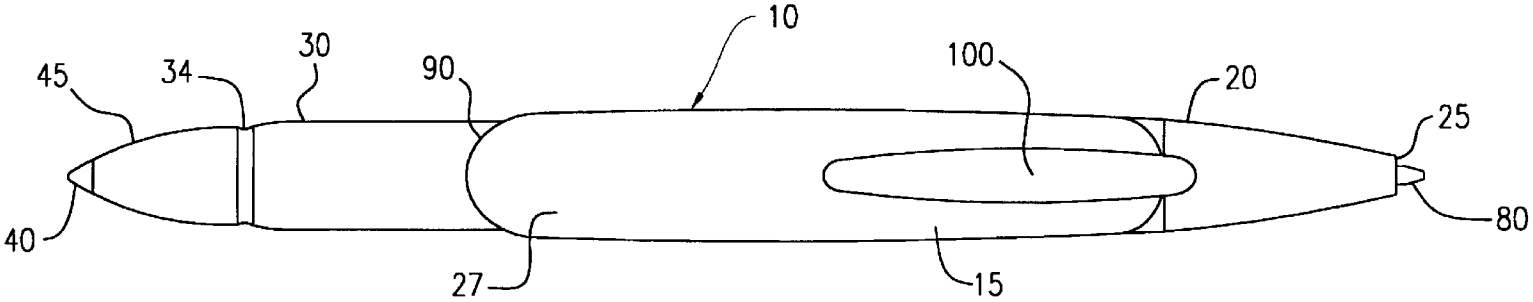
FIG. 1 is a top plan view of a writing instrument according to the invention with a marking tip exposed for use.
Figure 2:
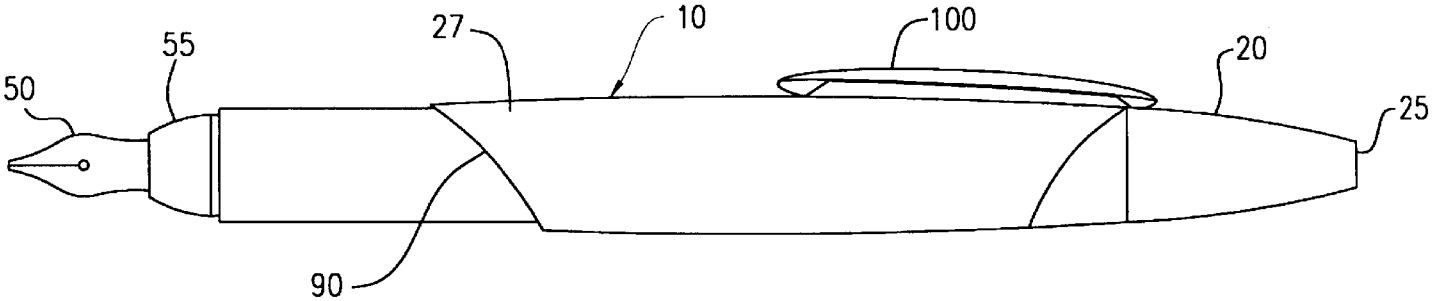
FIG. 2 is a side elevational view of the writing instrument of FIG. 1 with a different marking tip exposed for use.

Referring now to the drawings, in which like reference numerals are used to refer to the same or similar elements, FIGS. 1 and 2 show a multi-function writing instrument 10 of the invention having an elongated front section 15 and a separable rear section 30.

The front section 15 is a generally cylindrical body composed of a sleeve 27 and a front writing point 20. The writing point 20 is disposed at one front section end and the sleeve 27 is disposed at the other front section end of the front section 15. The front writing point 20 has an opening 25 sized to permit a ball point pen tip 80 to extend through it. Preferably, the front writing point 20 houses at least a pair of ball point pen tips 80, 82 (shown in FIG. 6) which are alternately selectable to a writing position, such as shown in FIG. 1, or both retracted to a non-use position, as shown in FIG. 2. The ball point pen tips 80, 82 may use replaceable ink refill cartridges.

Figure 6:
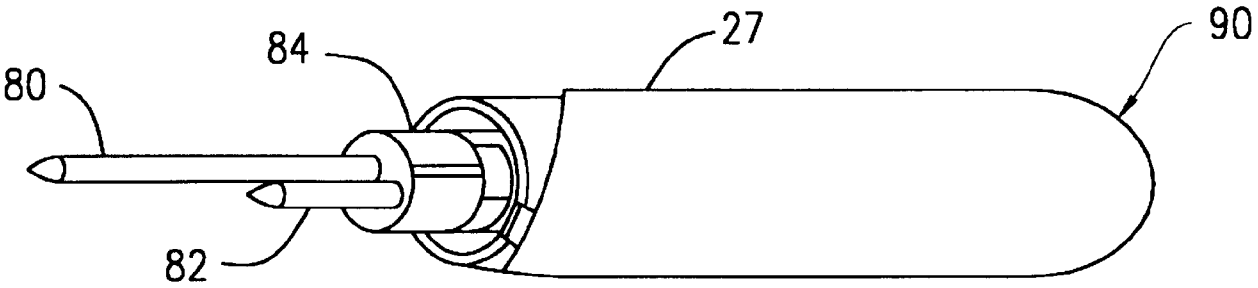
FIG. 6 is a front, side perspective view of the front section of the writing instrument of FIG. 1 with the writing tip removed.

A mechanism 84 such as shown in FIG. 6 may be used to extend and retract the ball point pen tips 80, 82 through the front writing point 20. The mechanism 84 may use any known selector for the purpose of extending one pen tip 80, 82 at a time or retracting both pen tips 80, 82.

Referring again to FIGS. 1 and 2, the sleeve 27 extends from the front writing point 20 and is open at the opposite end. The sleeve 27 includes a chamber inside the body accessed via the open end 90 (shown in FIG. 6) for removably receiving the rear section 30. The rear section 30 is preferably held in the sleeve 27 by a frictional fit.

Figure 3:
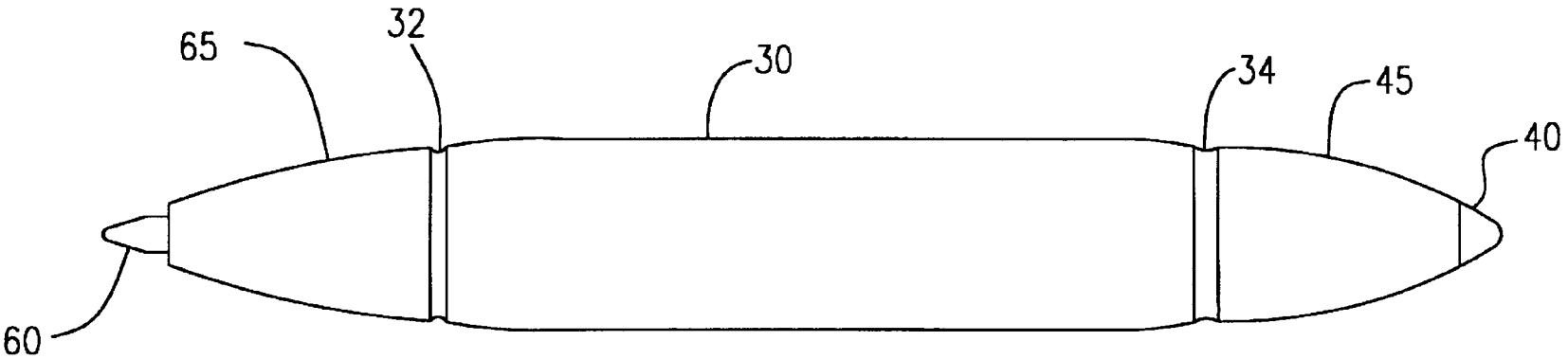
FIG. 3 is a side elevational view of an alternate rear section for use with the writing instrument of FIG. 1.
Figure 4:
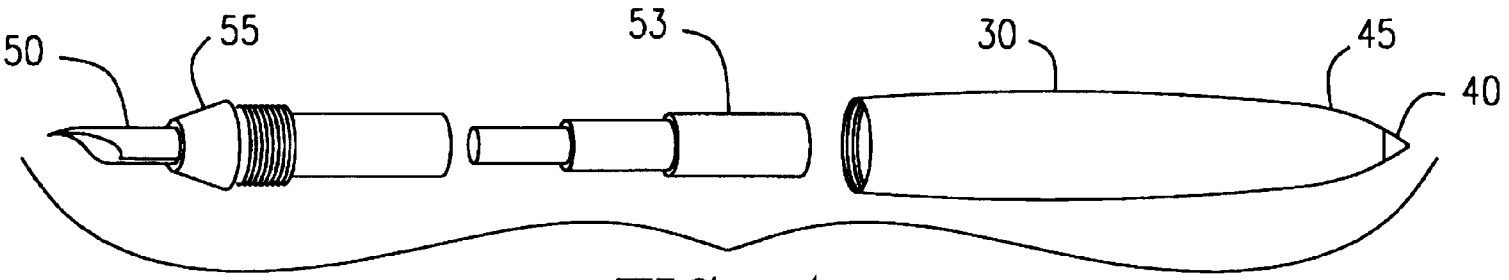
FIG. 4. is an exploded view of the rear section of FIG. 2.
Figure 5:
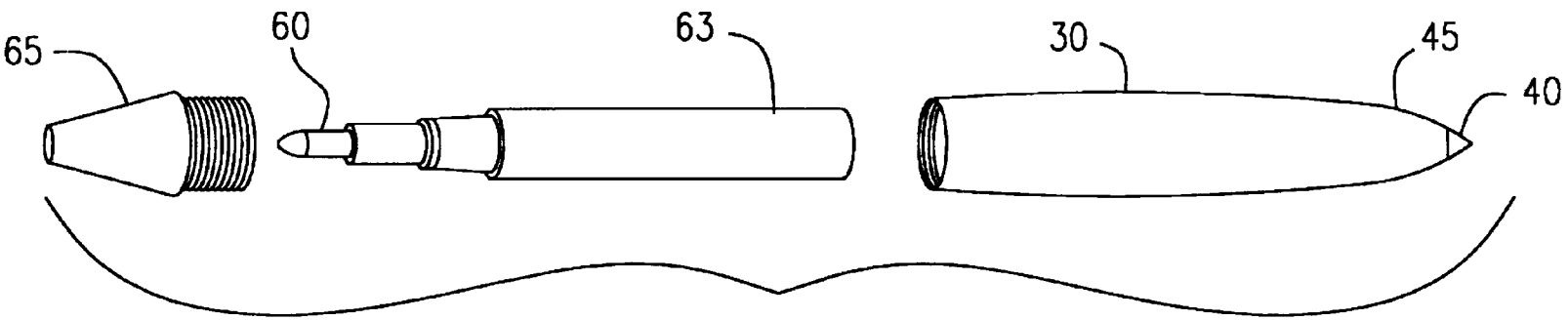
FIG. 5 is an exploded view of the rear section of FIG. 3.

As best seen in FIGS. 3–5, the rear section 30 body has a generally cylindrical barrel with a tapered writing point 45, 55 or 65 at each end. One rear section end has one writing point 45 and the other rear section end has another writing point 55 or 65. The rear section 30 has a shape which is generally bilaterally symmetrical, so that either end of the rear section 30 may be held inside the sleeve 27. Further, although the sleeve 27 and rear section 30 are shown as being cylindrical, their circumferences need only be complementary to each other. Thus, both could have triangular cross-sections or flattened sides, provided they are complementary by way of non-limiting examples.

Figure 7:
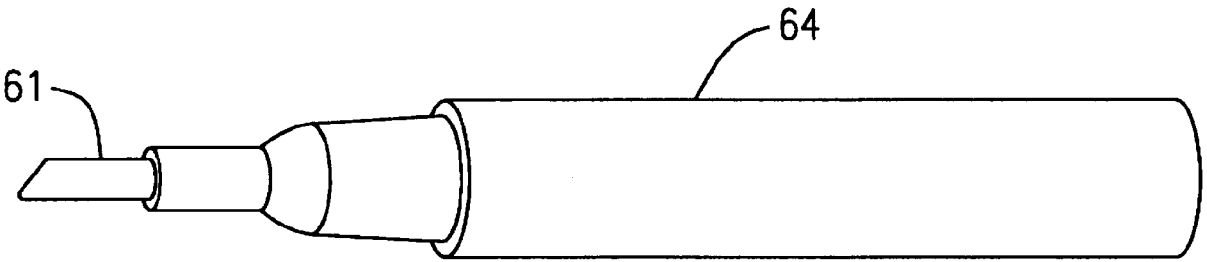
FIG. 7 is a front, side perspective view of an alternate refill with a different marking tip for use with the rear section of FIG. 5.

One of the rear section writing points 45 always has a non-marking stylus 40 supported thereon. The other rear section writing point 55 or 65 has an opening for permitting the pen tip of a rolling ball ink cartridge 60 or other type of marking tip held within the barrel of rear section 30 to extend through the writing point 55, 65. Alternative rear section writing points include a fountain pen nib 50, a gel ink or rolling ball tip 60 and a felt marker tip 61 (as shown in FIG. 7).

The marking tip of the rear section 30 is always extended through the opening of the second rear section writing point 55, 65 and is not retractable. However, the second rear section writing point 55, 65 may be unfastened from the body of rear section 30 to expose a refill cartridge 53, 63 as shown in FIGS. 4 and 5. Different refill cartridges may be substituted for each other inside the rear section 30 as well, such as the felt-tip marker cartridge 64 of FIG. 7 for the rolling ball cartridge 63 of FIG. 5.

Preferably, circumferential grooves 32, 34 are provided around the rear section 30 body at each end where the writing points 45, 55, 65 meet the cylindrical barrel. The grooves 32, 34 are positioned so that they can assist the frictional retention of the rear section 30 inside the sleeve 27, such as by mating with a corresponding ridge (not shown) inside the sleeve 27 in a known manner.

When the rear section 30 is joined with the front section 15, either the non-marking stylus 40 or one of the marking tips 50, 60, 61 is exposed for use. The other writing tip of the rear section 30 is protected inside sleeve 27.

Thus, using the multi-function writing instrument 10, a single marking tip can be exposed at a time for use, while other, different, marking tips available in the same writing instrument are protected from making stray marks. The multi-function writing instrument 10 provides the benefit of having several different types of writing instruments available in a single tool with multiple integrated parts. Each part is functional, however, unlike writing instruments having a separate cap which is non-functional except to cover a marking tip.

Multiple, different rear sections 30 may be provided for use with the front section 15, so that the multi-function writing instrument 10 can be configured by a user depending on their preference at a given time. For example, a rear section 30 having a stylus 40 and fountain pen tip 50 could be replaced by a second rear section 30 having a stylus tip 40 and a gel ink pen tip 60 or a third rear section 30 having a stylus tip 40 and marker tip 61, depending on the preferences of the user.

A pen clip 100 is optionally secured to one side of the front section extending from the front writing point 20 toward the open end 90 of sleeve 27. The clip 100 may be secured by any known means, such as by inserting a strip of metal connected to the clip into a corresponding slot in the front section.

The sheath 27 may have a beveled open end 90 as shown, or the end may be perpendicular to the longitudinal axis of the front section 15.

In a further embodiment, the stylus tip 40 may be replaceable when worn, such as by unfastening a threaded connection between the stylus tip and the first rear section writing point 45. A new stylus tip 40 can then be secured to the rear section 30.

While a specific embodiment of the invention has been shown and described in detail to illustrate the application of the principles of the invention, it will be understood that the invention may be embodied otherwise without departing from such principles.

What is claimed is:

1. A multi-function writing instrument comprising:

an elongated front section having a first writing point at one front section end and a sleeve at the other front section end, the sleeve being open to a chamber defined by the sleeve;

at least a pair of first marking tips held inside the front section, said marking tips being alternately selectable for extension through the first writing point to a use position;

a rear section having two ends, one rear section end being a second writing point and the other rear section end being a third writing point, the rear section being removably held within the chamber of the sleeve to alternately expose one of the second and third writing points and protect the other one of the second and third writing points;

a non-marking stylus tip at the second writing point;

a second marking tip at the third writing point, the second marking tip being of a different type than the first marking tips.

2. A multi-function writing instrument according to claim 1, wherein the first marking tips comprise ball point pen tips.

3. A multi-function writing instrument according to claim 2, wherein the second marking tip comprises one of a fountain pen tip, a rolling ball tip, a felt marker tip and a gel ink tip.

4. A multi-function writing instrument according to claim 1, further comprising a clip connected to the front section.

5. A multi-function writing instrument according to claim 1, wherein the non-marking stylus is replaceable.

6. A multi-function writing instrument according to claim 1, wherein the second marking tip further comprises a replaceable refill cartridge held inside the rear section.

7. A multi-function writing instrument according to claim 1, wherein the pair of first marking tips each further comprise a replaceable refill cartridge.

8. A multi-function writing instrument comprising:

a front section having first means for alternately extending one of at least a pair of first marking tips through a first writing point at one end of the front section or retracting both of the at least one pair of first marking tips to within the front section;

a rear section having a first refill cartridge with a second marking tip extending through a second writing point at one end of the rear section and a non-marking stylus at a third writing point at the opposite end of the rear section, the second marking tip being of a different type than the first marking tips; and second means for removably holding either end of the rear section inside a portion of the front section opposite the first writing point to enclose one of the second marking tip and non-marking stylus.

9. A multi-function writing instrument according to claim 8, further comprising substituting a second refill cartridge for the first refill cartridge, the second refill cartridge having a third marking tip different from the second marking tip.

10. A multi-function writing instrument according to claim 9, wherein the second marking tip is selected from the group consisting of a fountain pen tip, a felt marker tip, a gel ink tip and a rolling ball tip, and the third marking tip is a different type selected from the group consisting of a fountain pen tip, a felt marker tip, a gel ink tip and a rolling ball tip.

11. A multi-function writing instrument according to claim 10, wherein the first marking tips comprise ball point pen tips.

12. A multi-function writing instrument according to claim 8, wherein the second writing tip is one of a fountain pen tip, a felt marker tip, a gel ink tip and a rolling ball tip.

13. A multi-function writing instrument according to claim 12, wherein the first marking tips comprise ball point pen tips.

14. A multi-function writing instrument according to claim 8, wherein the first marking tips further comprise replaceable refill cartridges.

15. A multi-function writing instrument according to claim 8, wherein the non-marking stylus is replaceable.

16. A multi-function writing instrument comprising a front section under rear section wherein:

the front section has first means for alternately extending one of at least a pair of first marking tips through a first writing point at one end of the front section or retracting both of the first marking tips to within the front section;

the rear section being one of either a first rear section or at least one second rear section;

the first rear section having a first refill cartridge with a second marking tip extending through a second writing point at one end of the first rear section and a first non-marking stylus at a third writing point at the opposite end of the first rear section, the second marking tip being of a different type than the first marking tips;

the at least one second rear section having a second refill cartridge with a third marking tip extending through a fourth writing point at one end of the second rear section and a second non-marking stylus at a fifth writing point at the opposite en of the second rear section, the third marking tip being of a different type than each of the first and second marking tips;

second means for removably holding one of the first or second rear sections inside a portion of the front section opposite the first writing point to enclose one of the second marking tip, third marking tip, first non-marking stylus and second non-marking stylus.

17. A multi-function writing instrument according to claim 16, wherein the first marking tips comprise ball point pen tips.

18. A multi-function writing instrument according to claim 17, wherein the second and third marking tips are each selected from the group consisting of a fountain pen tip, a felt marker tip, a gel ink tip and a rolling ball tip.

19. A multi-function writing instrument according to claim 16, wherein the second and third marking tips are each selected from the group consisting of a fountain pen tip, a felt marker tip, a gel ink tip and a rolling ball tip.

* * * * *